US011702808B1

(12) United States Patent
Forbes

(10) Patent No.: US 11,702,808 B1
(45) Date of Patent: Jul. 18, 2023

(54) SNOW-REMOVING VEHICLE

(71) Applicant: Marton Forbes, Marietta, GA (US)

(72) Inventor: Marton Forbes, Marietta, GA (US)

( * ) Notice: Subject to any disclaimer, the term of this patent is extended or adjusted under 35 U.S.C. 154(b) by 204 days.

(21) Appl. No.: 17/114,646

(22) Filed: Dec. 8, 2020

(51) Int. Cl.
*E01H 5/10* (2006.01)
*E01H 5/09* (2006.01)
*E01H 5/06* (2006.01)

(52) U.S. Cl.
CPC ..... *E01H 5/102* (2013.01); *E01H 5/065* (2013.01); *E01H 5/092* (2013.01)

(58) Field of Classification Search
CPC ..... E01H 5/102; E01H 5/104; E01H 5/106; E01H 5/108; E01H 5/065; E01H 5/092
See application file for complete search history.

(56) References Cited

U.S. PATENT DOCUMENTS 361,739 A * 4/1887 Woodward ..... E01H 5/104 126/343.5 R
1,602,476 A * 10/1926 Ballard ..... E01H 5/104 37/227
2,104,363 A * 1/1938 Devlin ..... E01H 5/104 126/343.5 R
2,583,378 A * 1/1952 Kershaw ..... E01B 27/025 37/207
2,845,058 A * 7/1958 Wadsworth ..... E01H 5/104 37/227
2,977,955 A * 4/1961 Altenburg ..... E01H 5/104 37/227
3,011,493 A * 12/1961 Zieba ..... E01H 5/104 37/227
3,066,428 A * 12/1962 Raiti ..... E01H 5/104 126/343.5 R
3,106,792 A * 10/1963 Park ..... 37/227
3,108,586 A * 10/1963 Wilson ..... E01H 5/106 126/271.2 A
3,304,632 A * 2/1967 Kotlar ..... E01H 5/104 37/251
3,309,798 A * 3/1967 Devlin ..... E01H 5/104 37/270
3,333,354 A * 8/1967 Kirshenblat ..... E01H 5/104 219/202
3,353,286 A * 11/1967 Alexander ..... E01H 5/104 126/343.5 R
3,387,603 A * 6/1968 Alexander ..... E01H 5/104 431/62
3,393,462 A * 7/1968 Picker ..... E01H 5/104 37/232
3,404,470 A * 10/1968 Raiti ..... E01H 5/104 126/343.5 R
3,405,705 A * 10/1968 Devlin ..... E01H 5/104 126/343.5 R (Continued)

*Primary Examiner* — Jamie L McGowan
(74) *Attorney, Agent, or Firm* — Kyle A. Fletcher, Esq.

(57) ABSTRACT

The snow-removing vehicle may comprise a snow collector, a vacuum, a tank, a steam chamber, and a vehicle. As the vehicle drives through snow, the snow collector may remove the snow from a roadway and may direct the snow towards a vacuum hose. The vacuum may draw the snow from the snow collector, through the vacuum hose, and into the tank. The snow may be heated while in the tank and may melt into water. The heating may turn the water into steam. The steam may collect in the steam chamber before being expelled from the vehicle via one or more exhaust fans.

17 Claims, 5 Drawing Sheets

(56) References Cited

U.S. PATENT DOCUMENTS 3,452,459 A * 7/1969 Campion ..... E01H 5/104 219/421
3,464,128 A * 9/1969 Krickovich ..... E01H 5/104 126/343.5 R
3,484,961 A * 12/1969 Coslowsky ..... E01H 5/104 37/305
3,619,918 A * 11/1971 Morin ..... E01H 5/104 126/343.5 R
3,766,586 A * 10/1973 Krickovich ..... E01H 1/0845 15/83
3,803,732 A * 4/1974 Moreno ..... E01H 5/104 37/251
3,866,340 A * 2/1975 Krickovich ..... E01H 5/098 37/270
3,979,794 A 9/1976 Brown
4,071,966 A * 2/1978 Cohen ..... E01H 5/104 193/31 A
4,164,820 A * 8/1979 Krickovich ..... E01H 5/104 15/340.3
4,226,034 A * 10/1980 Benjamin ..... E01H 5/106 15/340.1
4,353,176 A * 10/1982 Hess ..... E01H 5/104 126/343.5 R
4,443,958 A * 4/1984 Huotari ..... E01H 5/098 37/238
4,633,603 A * 1/1987 David ..... E01H 5/106 37/197
4,785,561 A * 11/1988 Swanson ..... E01H 5/104 126/343.5 R
5,079,865 A * 1/1992 Hutson ..... E01H 5/104 37/238
5,365,681 A * 11/1994 Miranda ..... E01H 5/104 37/227
5,588,231 A * 12/1996 Mavrianos ..... E01H 5/104 37/227
5,630,286 A * 5/1997 Vanderlinden ..... E01H 5/104 15/322
5,787,613 A * 8/1998 Derome ..... E01H 5/104 126/343.5 R
5,953,837 A * 9/1999 Clifford ..... E01H 5/104 37/255
5,956,872 A * 9/1999 Mavrianos ..... E01H 5/104 126/343.5 R
6,305,105 B1 * 10/2001 Lowman ..... E01H 5/104 37/228
D450,715 S 11/2001 Adams
6,904,708 B2 * 6/2005 Rogers ..... E01H 5/104 37/219
9,695,562 B2 7/2017 Lukaj
9,732,489 B1 * 8/2017 Whitney ..... E01H 5/104
10,006,182 B1 * 6/2018 Cho ..... E01H 5/104
10,024,012 B1 * 7/2018 Williams ..... E01H 5/104
10,138,608 B2 11/2018 Cho
10,280,576 B1 5/2019 Osorio
2004/0074114 A1 * 4/2004 Rogers ..... E01H 5/104 37/228
2006/0272182 A1 * 12/2006 Gertner ..... E01H 5/104 37/227
2009/0217554 A1 * 9/2009 Tucker ..... E01H 5/102 37/228
2010/0313451 A1 * 12/2010 Trubiano ..... E01H 5/104 37/228
2013/0219756 A1 * 8/2013 Lee ..... E01H 5/104 37/228
2014/0305010 A1 * 10/2014 Fonseca ..... E01H 5/104 37/228
2015/0315758 A1 * 11/2015 Spievey ..... E01H 5/102 37/229
2016/0053452 A1 * 2/2016 Treglown ..... E01H 5/104 37/228
2016/0258123 A1 * 9/2016 Lukaj ..... E01H 5/104
2016/0369468 A1 * 12/2016 Winters ..... E01H 5/061

* cited by examiner

SNOW-REMOVING VEHICLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of snow removal equipment, more specifically, a snow-removing vehicle.

SUMMARY OF INVENTION

The snow-removing vehicle may comprise a snow collector, a vacuum, a tank, a steam chamber, and a vehicle. As the vehicle drives through snow, the snow collector may remove the snow from a roadway and may direct the snow towards a vacuum hose. The vacuum may draw the snow from the snow collector, through the vacuum hose, and into the tank. The snow may be heated while in the tank and may melt into water. The heating may turn the water into steam. The steam may collect in the steam chamber before being expelled from the vehicle via one or more exhaust fans.

An object of the invention is to remove snow from a roadway using a shovel of a snow collector.

Another object of the invention is to vacuum the snow into a tank where one or more heating coils melt the snow and boil the melted snow to form steam.

A further object of the invention is to collect the steam in a steam chamber and to expel the steam from the steam chamber via one or more exhaust fans.

Yet another object of the invention is to provide a shovel cleaner that wipes accumulated snow off of the face of the shovel These together with additional objects, features and advantages of the snow-removing vehicle will be readily apparent to those of ordinary skill in the art upon reading the following detailed description of the presently preferred, but nonetheless illustrative, embodiments when taken in conjunction with the accompanying drawings.

In this respect, before explaining the current embodiments of the snow-removing vehicle in detail, it is to be understood that the snow-removing vehicle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the snow-removing vehicle.

It is therefore important that the claims be regarded as including such equivalent construction insofar as they do not depart from the spirit and scope of the snow-removing vehicle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
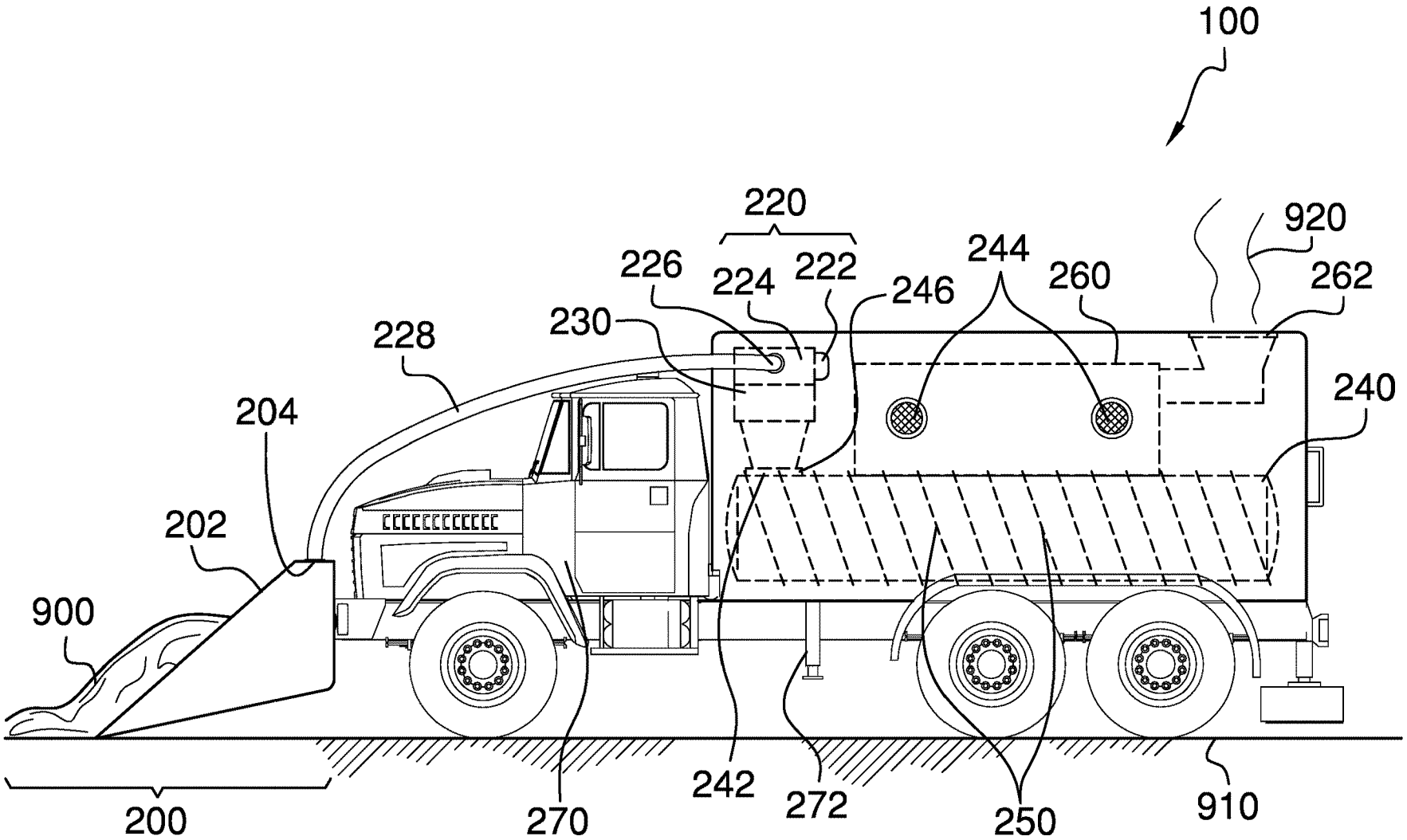
FIG. 1 is a side view of an embodiment of the disclosure.
Figure 2:
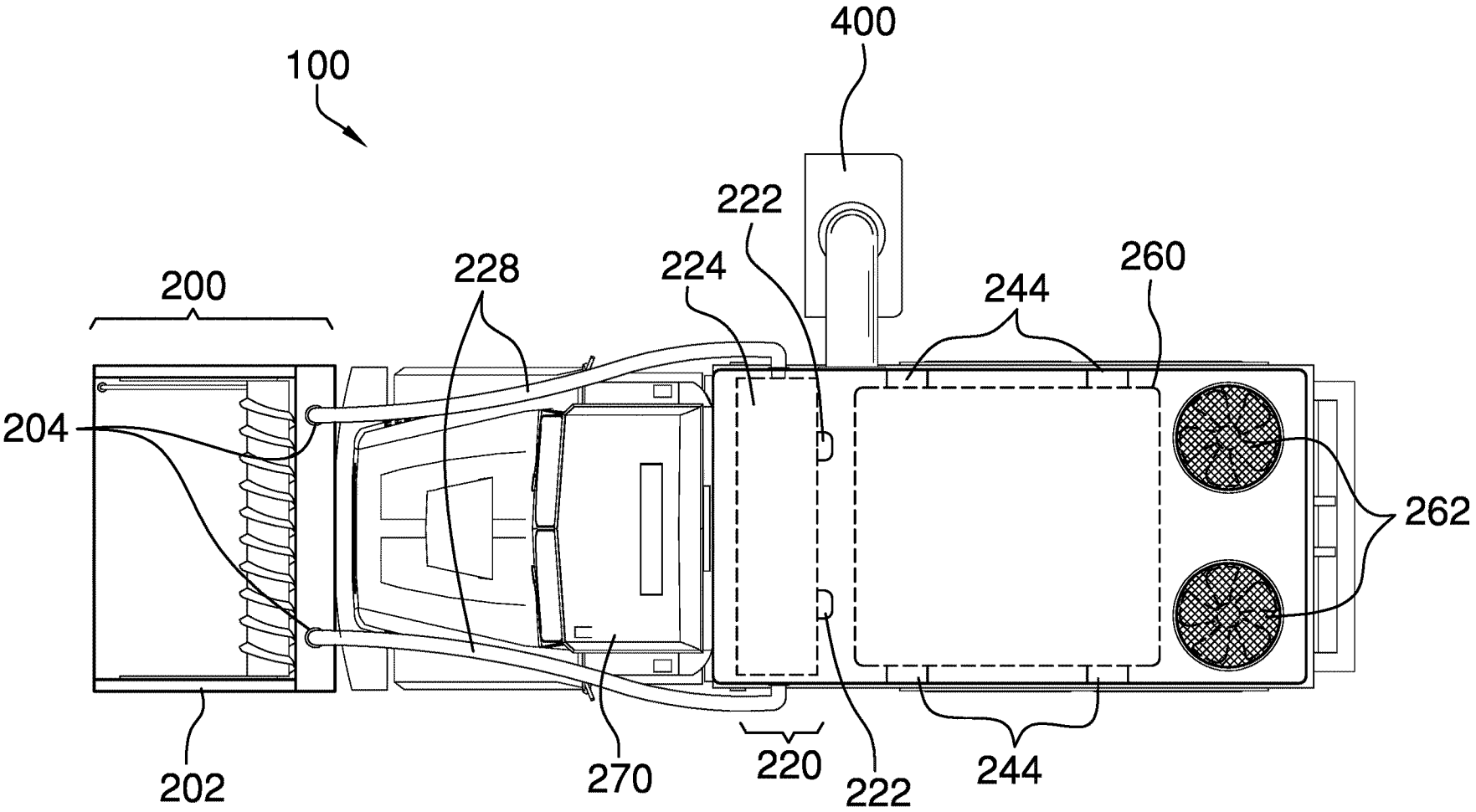
FIG. 2 is a top view of an embodiment of the disclosure.
Figure 3:
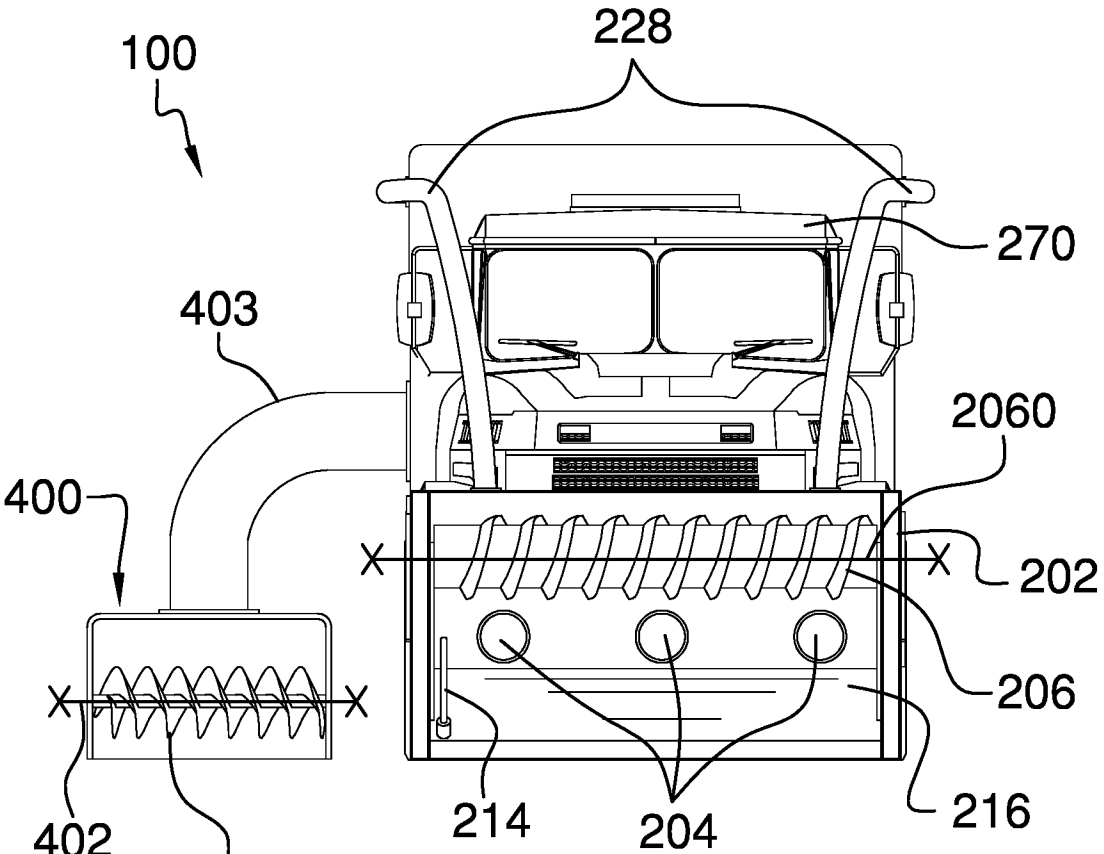
FIG. 3 is a front view of an embodiment of the disclosure.
Figure 4:
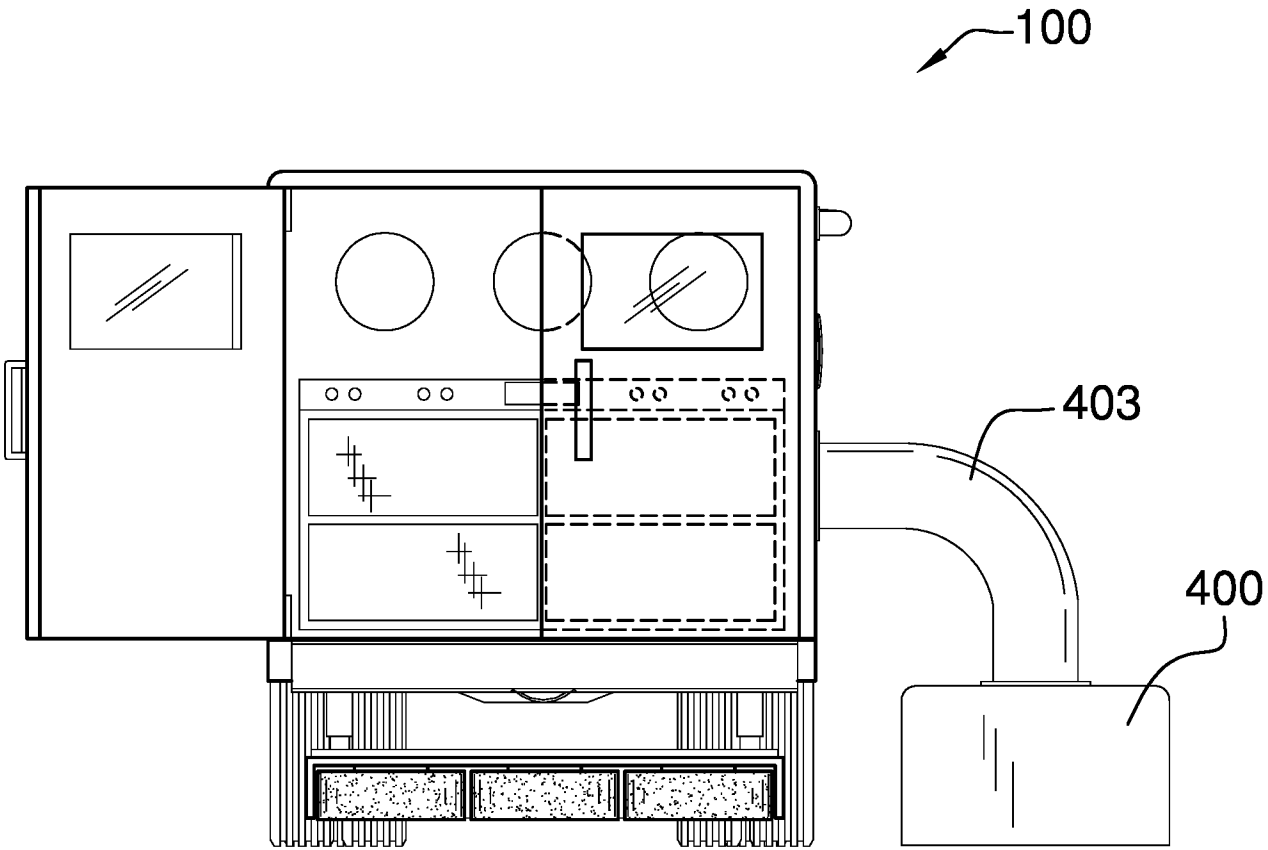
FIG. 4 is a rear view of an embodiment of the disclosure.
Figure 5:
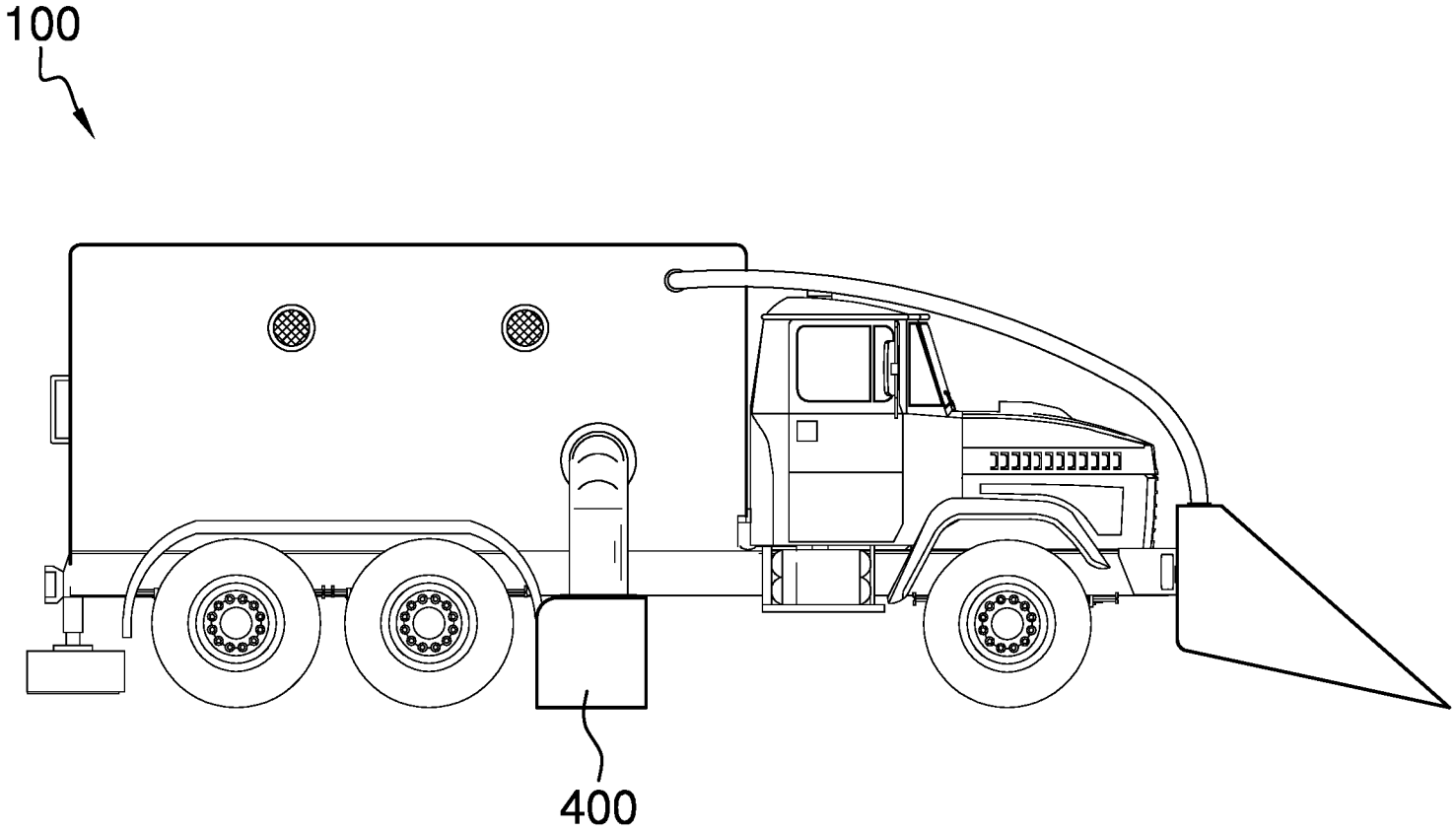
FIG. 5 is another side view of an embodiment of the disclosure.

Detailed reference will now be made to a first potential embodiment of the disclosure, which is illustrated in FIGS. 1 through 5.

The snow-removing vehicle 100 (hereinafter invention) comprises a snow collector 200, a vacuum 220, a tank 240, a steam chamber 260, and a vehicle 270. As the vehicle 270 drives through snow 900, the snow collector 200 may remove the snow 900 from a roadway 910 and may direct the snow 900 towards a vacuum hose 228. The vacuum 220 may draw the snow 900 from the snow collector 200, through the vacuum hose 228, and into the tank 240. The snow 900 may be heated while in the tank 240 and may melt into water. The heating may turn the water into steam 920. The steam 920 may collect in the steam chamber 260 before being expelled from the vehicle 270 via one or more exhaust fans 262.

The snow collector 200 may comprise a shovel 202 and a shovel outlet 204. The shovel 202 may be a concave plow suspended on the front of the vehicle 270 such that the bottom of the shovel 202 touches the roadway 910. The shovel 202 may push the snow 900 off of the roadway 910 and upwards as the vehicle 270 moves forward. The shovel outlet 204 may be located at the top of the shovel 202. The shovel outlet 204 may be coupled to the vacuum hose 228.

The snow 900 may be vacuumed out of the snow collector 200 via the shovel outlet 204 as the snow 900 reaches the top of the shovel 202.

In some embodiments, the bottom of the shovel 202 may comprise a brush 206 to sweep the snow 900 from irregularities in the surface of the roadway 910. The brush 206 may be horizontally oriented and may extend from one side of the shovel 202 to the opposite side of the shovel 202. The brush 206 may be able to spin about a horizontal axis 2060.

In some embodiments, the invention 100 may include a second shovel 400. The second shovel 400 is ideally designed for use with a sidewalk. The second shovel 400 has a second brush 401 that spins about a second horizontal axis 402. The second shovel 400 includes a second vacuum hose 403, which connects over to the vacuum 220.

The vacuum 220 may comprise a motor 222, a blower 224, an enclosure 226, and the vacuum hose 228. The vacuum 220 may pull the snow 900 through the vacuum hose 228 from the snow collector 200 and may deposit the snow 900 into the tank 240. The motor 222 may convert electrical energy into mechanical energy.

The blower 224 may be an air-moving device configured to move air from within the enclosure 226 to the outside, thus creating a partial vacuum within the enclosure 226 of the vacuum 220.

During a first operating phase, the partial vacuum created by the blower 224 may draw the snow 900 from the snow collector 200 via the vacuum hose 228. The snow 900 that is pulled through the vacuum hose 228 by the partial vacuum may be propelled into the tank 240. The vacuum hose 228 may be a semi-rigid conduit for the snow 900. The vacuum hose 228 may be coupled at a front end of the vacuum hose 228 to the shovel outlet 204 and at a rear end of the vacuum hose 228 to the enclosure 226 of the vacuum 220.

In some embodiments, the vacuum 220 may comprise a filter 230. The filter 230 may prevent a debris from passing into the tank 240. In some embodiments, the filter 230 may be removable for cleaning. As a non-limiting example, the filter 230 may comprise a mesh screen that may be removed for cleaning.

The tank 240 may be a container for holding the snow 900 that is removed from the roadway 910 by the vacuum 220. The snow 900 may be added to the tank 240 via a tank inlet 242. The tank 240 may comprise a valve 246 at the tank inlet 242 such that the tank inlet 242 may be blocked when the valve 246 is closed.

The tank 240 may comprise one or more heating coils 250. As a non-limiting example, the one or more heating coils 250 may surround the tank 240. The one or more heating coils 250 may elevate the temperature of the tank 240 when energized by an electrical potential. During a second operating phase, the one or more heating coils 250 may be energized to melt the snow 900. In some embodiments, the second operating phase may be concurrent with the first operating phase such that the snow 900 may begin melting while the snow 900 is being collected by the vehicle 270.

During a third operating phase, the water in the tank 240 may be boiled to make the steam 920. The vacuum 220 may be stopped and the valve 246 may be closed during the third operating phase. As the water boils, the steam 920 may increase pressure within the tank 240, forcing the steam 920 through one or more tank outlets 244 into the steam chamber 260. The steam 920 may be expelled from the steam chamber 260 using the one or more exhaust fans 262.

In some embodiments, the vehicle 270 may be stopped during the third operating phase and a plurality of safety stands 272 may be deployed beneath the periphery of the tank 240 to increase the stability of the vehicle 270.

In use, the vehicle 270 is driven on the roadway 910 comprising a covering of snow 900. The shovel 202 of the snow collector 200 may push the snow 900 forward and upwards against the face 216 of the shovel 202. With the motor 222 of the vacuum 220 energized to turn the blower 224, the partial vacuum may be created within the enclosure 226 of the vacuum 220 and within the vacuum hose 228. As the snow 900 reaches the top of the shovel 202, the snow 900 may be sucked into the shovel outlet 204 and through the vacuum hose 228. The snow 900 may pass through the valve 246 and may collect within the tank 240. The one or more heating coils 250 may be energized to begin heating the tank 240. When the tank 240 is full of the snow 900 (or earlier if desired), the vehicle 270 may be stopped and the valve 246 may be closed. The plurality of safety stands 272 may be deployed to stabilize the vehicle 270. The snow 900 may be heated until it melts and begins to boil. The steam 920 produced by boiling melted snow may pass from the tank 240 into the steam chambers 260 and may be expelled from the steam chamber 260 by the one or more exhaust fans 262.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, a "blower" may be a type of air-moving device that creates a current of air at its exhaust point. Many blowers use an impeller to move the air.

As used in this disclosure, "concave" may be used to describe a surface that resembles the interior surface of a sphere or a portion thereof.

As used herein, the words "couple", "couples", "coupled" or "coupling", may refer to connecting, either directly or indirectly, and does not necessarily imply a mechanical connection.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, a "motor" may refer to a device that transforms energy from an external power source into mechanical energy.

As used herein, "resilient" or "semi-rigid" may refer to an object or material which will deform when a force is applied to it and which will return to its original shape when the deforming force is removed.

As used herein, "rigid" may refer to an object or material which is inflexible. A rigid object may break if force is applied to the object.

As used herein, "vehicle" may refer to a device that is used for transporting passengers, goods, or equipment.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A snow-removing vehicle comprising:

a snow collector, a vacuum, a tank, a steam chamber, and a vehicle;

wherein as the vehicle drives through snow, the snow collector removes the snow from a roadway and directs the snow towards a vacuum hose;

wherein the vacuum draws the snow from the snow collector, through the vacuum hose, and into the tank;

wherein the snow is heated while in the tank and melts into water;

wherein the heating turns the water into steam;

wherein the steam collects in the steam chamber and is expelled from the vehicle via one or more exhaust fans;

wherein the snow collector comprises a shovel and a shovel outlet;

wherein the shovel is a concave plow suspended on the front of the vehicle such that the bottom of the shovel touches the roadway;

wherein the shovel pushes the snow off of the roadway and upwards as the vehicle moves forward;

wherein a second shovel is configured for use in cleaning off a sidewalk;

wherein the second shovel has a brush that spins about a horizontal axis;

wherein the second shovel includes a second vacuum hose, which connects over to the vacuum.

2. The snow-removing vehicle according to claim 1 wherein the shovel outlet is located at the top of the shovel;

wherein the shovel outlet is coupled to the vacuum hose.

3. The snow-removing vehicle according to claim 2 wherein the snow is vacuumed out of the snow collector via the shovel outlet as the snow reaches the top of the shovel.

4. The snow-removing vehicle according to claim 3 wherein the bottom of the shovel comprises a brush to sweep the snow from irregularities in the surface of the roadway;

wherein the brush is horizontally oriented and extends from one side of the shovel to the opposite side of the shovel.

5. The snow-removing vehicle according to claim 3 wherein the shovel comprises a shovel cleaner;

wherein the shovel cleaner removes the snow that has stuck to the front of the shovel by wiping a wiper across a face of the shovel.

6. The snow-removing vehicle according to claim 5 wherein the wiper is a squeegee shaped to match the curve of the shovel;

wherein the wiper is moved across the face of the shovel by a wiper arm.

7. The snow-removing vehicle according to claim 3 wherein the vacuum comprises a motor, a blower, an enclosure, and the vacuum hose;

wherein the vacuum pulls the snow through the vacuum hose from the snow collector and deposits the snow into the tank;

wherein the motor converts electrical energy into mechanical energy.

8. The snow-removing vehicle according to claim 7 wherein the blower is an air-moving device configured to move air from within the enclosure to the outside, thus creating a partial vacuum within the enclosure of the vacuum.

9. The snow-removing vehicle according to claim 8 wherein during a first operating phase, the partial vacuum created by the blower draws the snow from the snow collector via the vacuum hose;

wherein the snow that is pulled through the vacuum hose by the partial vacuum is propelled into the tank;

wherein the vacuum hose is a semi-rigid conduit for the snow;

wherein the vacuum hose is coupled at a front end of the vacuum hose to the shovel outlet and at a rear end of the vacuum hose to the enclosure of the vacuum.

10. The snow-removing vehicle according to claim 9 wherein the vacuum comprises a filter;

wherein the filter prevents a debris from passing into the tank.

11. The snow-removing vehicle according to claim 9 wherein the tank is a container for holding the snow that is removed from the roadway by the vacuum;

wherein the snow is added to the tank via a tank inlet.

12. The snow-removing vehicle according to claim 11 wherein the tank comprises a valve at the tank inlet such that the tank inlet is blocked when the valve is closed.

13. The snow-removing vehicle according to claim 12 wherein the tank comprises one or more heating coils;

wherein the one or more heating coils elevate the temperature of the tank when energized by an electrical potential.

14. The snow-removing vehicle according to claim 13 wherein during a second operating phase, the one or more heating coils are energized to melt the snow.

15. The snow-removing vehicle according to claim 14 wherein during a third operating phase, the water in the tank is boiled to make the steam;

wherein the vacuum is stopped and the valve is closed during the third operating phase.

16. The snow-removing vehicle according to claim 15 wherein as the water boils, the steam increases pressure within the tank, forcing the steam through one or more tank outlets into the steam chamber;

wherein the steam is expelled from the steam chamber using the one or more exhaust fans.

17. The snow-removing vehicle according to claim 16 wherein the vehicle is stopped during the third operating phase and a plurality of safety stands are deployed beneath the periphery of the tank to increase the stability of the vehicle.

* * * * *